US007644697B2

(12) United States Patent
Samo et al.

(10) Patent No.: US 7,644,697 B2
(45) Date of Patent: Jan. 12, 2010

(54) GOVERNOR DEVICE

(75) Inventors: Jyunichi Samo, Osaka (JP); Toshio Kamiyama, Osaka (JP); Masashi Sagara, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 85 days.

(21) Appl. No.: 10/577,237

(22) PCT Filed: Aug. 20, 2004

(86) PCT No.: PCT/JP2004/012020

§ 371 (c)(1),
(2), (4) Date: Feb. 22, 2007

(87) PCT Pub. No.: WO2005/040583

PCT Pub. Date: May 6, 2005

(65) Prior Publication Data

US 2007/0144484 A1 Jun. 28, 2007

(30) Foreign Application Priority Data

Oct. 27, 2003 (JP) ..... 2003-365905

(51) Int. Cl.
*F02D 31/00* (2006.01)

(52) U.S. Cl. ..... 123/373; 123/388; 123/379; 123/365

(58) Field of Classification Search ..... 123/366, 123/373, 295, 90.11–90.19, 90.1
See application file for complete search history.

(56) References Cited

U.S. PATENT DOCUMENTS 4,355,609 A * 10/1982 Skinner ..... 123/373
6,953,022 B1 * 10/2005 Itsuki et al. ..... 123/373
7,357,105 B2 * 4/2008 Moriwaki et al. ..... 123/90.12
2004/0163622 A1 * 8/2004 Sakaguchi et al. ..... 123/366

FOREIGN PATENT DOCUMENTS

| | | |
|---|---|---|
| GB | 1300708 | 12/1972 |
| GB | 1451059 | 9/1976 |
| JP | 63-246421 A | 10/1988 |
| JP | 63-297738 A | 12/1988 |
| JP | 2003-3866 A | 1/2003 |
| JP | 2003-269194 A | 9/2003 |

OTHER PUBLICATIONS

International Search Report for International Application PCT/JP2004/012020 dated Dec. 7, 2004.
Supplementary European Search Report of Application No. EP04 77 1981 dated Mar. 14, 2008, 2 pgs.

* cited by examiner

*Primary Examiner*—Stephen K Cronin
*Assistant Examiner*—Keith Coleman
(74) *Attorney, Agent, or Firm*—Sterne, Kessler, Goldstein & Fox P.L.L.C.

(57) ABSTRACT

A governor device comprises a first lever connecting a governor lever to a rotary speed setting lever interlockingly, a second lever pivotally supported by the first lever, and a third lever pivotally supported by the second lever, regulated its rotation amount by the second lever and interlocked with a governor weight. A fuel injection compensation spring is provided between the first lever and the second lever so as to bias them for decreasing the rotary speed for a fixed amount at the time of low speed rotation. A compensation starting rotary speed setting device, which is a set load changing means for the fuel injection compensation spring, is provided on the first lever near the fuel injection compensation spring.

20 Claims, 8 Drawing Sheets

GOVERNOR DEVICE

THE TECHNICAL FIELD TO WHICH THE INVENTION BELONGS

The present invention relates to a governor device of an internal combustion engine such as a diesel engine. Especially, the present invention relates to an adjustment mechanism of a control starting rotary speed in a mechanism decreasing a limit fuel injection amount compulsorily so as to rationalize a limit torque in middle and low speed range concerning the relation between the engine rotary speed and the limit torque.

DESCRIPTION OF THE PRIOR ART

Conventionally, there is well known an art providing a centrifugal governor device in a diesel engine. With regard to the centrifugal governor device, a camshaft and a governor shaft are rotatively driven by a crank gear provided on a crankshaft through a gear or the like. A governor weight is engaged with the governor shaft from the outside. The governor weight is interlocked with a governor lever through a governor sleeve. The governor lever is constructed by three levers and is interlocked with a fuel adjusting rack of a fuel injection pump (for example, see the Patent Literature 1).

With regard to this construction, when the engine is started, the engine is rotated in a set rotary speed. Then, when the rotary speed becomes higher than the set rotary speed, the governor weight is opened by the centrifugal force so as to make the governor sleeve side. Consequently, the governor lever is rotated so as to move the fuel adjusting rack toward the fuel decrease side, thereby decreasing the injection amount of the fuel injection pump. On the contrary, when the rotary speed is decreased and the centrifugal force acting on the governor weight becomes small, the governor weight is closed by a spring biasing oppositely, thereby moving the fuel adjusting rack toward the fuel increase side.

Normally, for preventing the engine failure even if the load is increased based on a rated point, the relation between the limit torque and the rotary speed of the diesel engine is set so that the limit torque is increased when the rotary speed is decreased following the increase of the load. However, if the increase of the limit torque following the decrease of the rotary speed extends to the middle and low speed range, the durability becomes worse by the increase of the explosion pressure or the temperature of exhaust gas, and the exhaust emission such as black smoke in the exhaust gas is increased. Accordingly, with regard to an engine with such a characteristic, it is necessary to decrease the fuel injection amount compulsorily by the governor device for preventing the limit torque in the middle and low speed range from increasing excessively. However, the decrease amount must be controlled properly so as to keep the torque required by a working machine.

For that reason, there is a governor device provided therein with a lever and a spring or the like so as to suppress the fuel injection amount in the middle and low speed range. In this construction, the increase of the fuel injection amount from the set rotary speed is suppressed when the rotary speed is decreased from the rated rotary speed. However, a little dispersion in characteristics exist between each engine, and it is necessary to change the attachment position of the spring or exchange the spring for another one so as to adjust the dispersion. The adjustment cannot be performed from the outside and it is necessary to disassemble a casing for the adjustment, therefore the adjustment work is very troublesome.

Patent Literature 1: the Japanese Patent No. 2873727

SUMMARY OF THE INVENTION

Problems to be Solved by the Invention

The purpose of the present invention is to make a limit starting position of the fuel injection amount to be set easily from the outside.

Means for Solving the Problems

A governor device according to the present invention, comprising a first lever connecting a governor lever to a rotary speed setting lever interlockingly; a second lever pivotally supported by the first lever; and a third lever pivotally supported by the second lever, regulated its rotation amount by the second lever and interlocked with the governor weight, is characterized in that an elastic member is provided between the first lever and the second lever so as to bias the levers for decreasing the rotary speed for a fixed amount at the time of low speed rotation, and a set load changing means for the elastic member is provided on the first lever near the elastic member.

With regard to the governor device according to the present invention, a bracket for the elastic member at the side of the first lever is constructed by an elastic plate, the elastic plate touches an outer peripheral surface of an adjusting shaft, and a distance between the outer peripheral surface of the adjusting shaft and an axis is changed by stages.

With regard to the governor device according to the present invention, a rotation limiting member is projected from one of ends of the adjusting shaft, and a projection which can touch the rotation limiting member is provided on a plate supporting the adjusting shaft.

With regard to the governor device according to the present invention, an engaging part for an adjusting operation means is formed on one of sides of the adjusting shaft.

With regard to the governor device according to the present invention, the elastic member and the adjusting shaft are provided oppositely to a pivotal support part of the first lever and the second lever.

EFFECT OF THE INVENTION

A governor device according to the present invention, comprising a first lever connecting a governor lever to a rotary speed setting lever interlockingly; a second lever pivotally supported by the first lever; and a third lever pivotally supported by the second lever, regulated its rotation amount by the second lever and interlocked with the governor weight, is characterized in that an elastic member is provided between the first lever and the second lever so as to bias the levers for decreasing the rotary speed for a fixed amount at the time of low speed rotation, and a set load changing means for the elastic member is provided on the first lever near the elastic member. Accordingly, by adjusting the set load changing means, the set compensation fuel injection value can be changed so as to prevent the dispersion of each governor device. Since the set compensation fuel injection value can be changed, the torque can be controlled in the low rotation range.

With regard to the governor device according to the present invention, a bracket for the elastic member at the side of the first lever is constructed by an elastic plate, the elastic plate touches an outer peripheral surface of an adjusting shaft, and a distance between the outer peripheral surface of the adjusting shaft and an axis is changed by stages. Accordingly, the compensation fuel injection amount is set in stages by rotating the adjusting shaft. Therefore, the change value is also changed by stages, whereby the setting can be changed easily. When the adjusting shaft is rotated, the shaft can be stopped by stages, whereby the resettability is improved.

With regard to the governor device according to the present invention, a rotation limiting member is projected from one of the ends of the adjusting shaft, and a projection which can touch the rotation limiting member is provided on a plate supporting the adjusting shaft. Accordingly, the rotary range of the adjusting shaft can be adjusted with easy construction. Since the adjusting shaft cannot be rotated for 360 degrees or more, the adjusted position can be recognized sensuously easily, whereby any scale is not necessary to be provided.

With regard to the governor device according to the present invention, an engaging part for an adjusting operation means is formed on one of the sides of the adjusting shaft. Accordingly, the set compensation fuel injection value can be changed easily from the outside of the engine by adjusting operation means. The adjusting operation means is not necessary without at the time of the adjusting so as not to obstruct the action of the governor, whereby the governor device can be constructed compactly. Furthermore, the engaging part for the adjusting operation means can be constructed simply, whereby the adjusting shaft can be constructed cheaply.

With regard to the governor device according to the present invention, the elastic member and the adjusting shaft are provided oppositely to a pivotal support part of the first lever and the second lever. Accordingly, the elastic member and the adjusting shaft are disposed far from the rotary fulcrum of the first lever and the second lever, whereby the operating force required for the change and adjustment of the set compensation fuel injection value may be small so that the fine adjustment can be performed easily. The action force also may be small, whereby the spring constant of the elastic member may be small so that the elastic member can be constructed cheaply.

DESCRIPTION OF NOTATIONS

Figure 1:
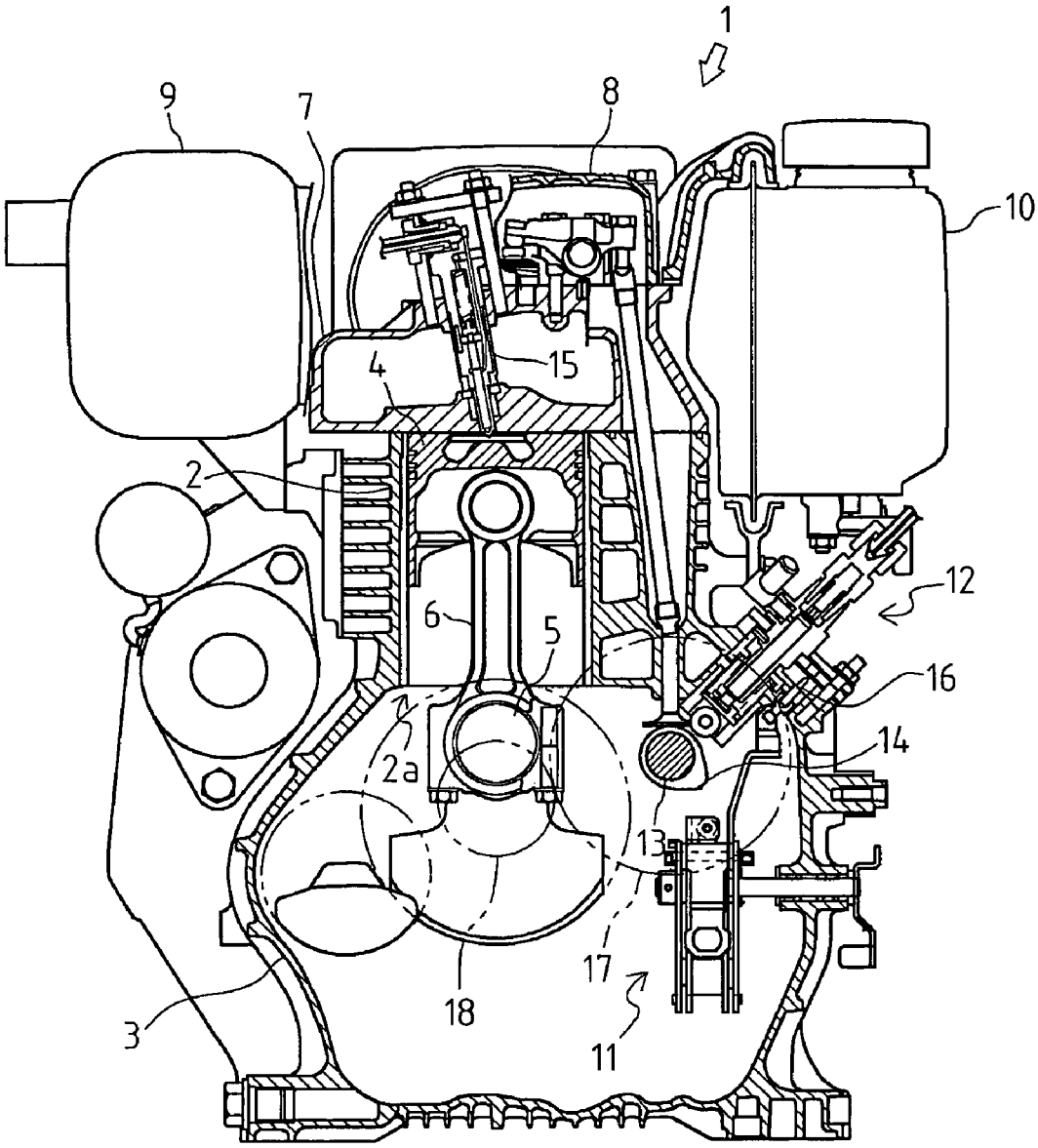
FIG. 1 It is a sectional front view of an entire construction of an engine according to the present invention.

1 an engine
11 a governor device
22 a governor weight
24 a governor sleeve
26 a regulator lever
29 a rotary speed setting lever
30 a governor lever
31 a first lever
32 a second lever
33 a third lever
35 an elastic plate
38 a fuel injection compensation spring (an elastic member)
45 an adjusting shaft
46 a rotation limiting member
47 projections
50 a compensation starting rotary speed setting device (a set load changing means)

THE BEST MODE OF EMBODIMENT OF THE INVENTION

Figure 3:
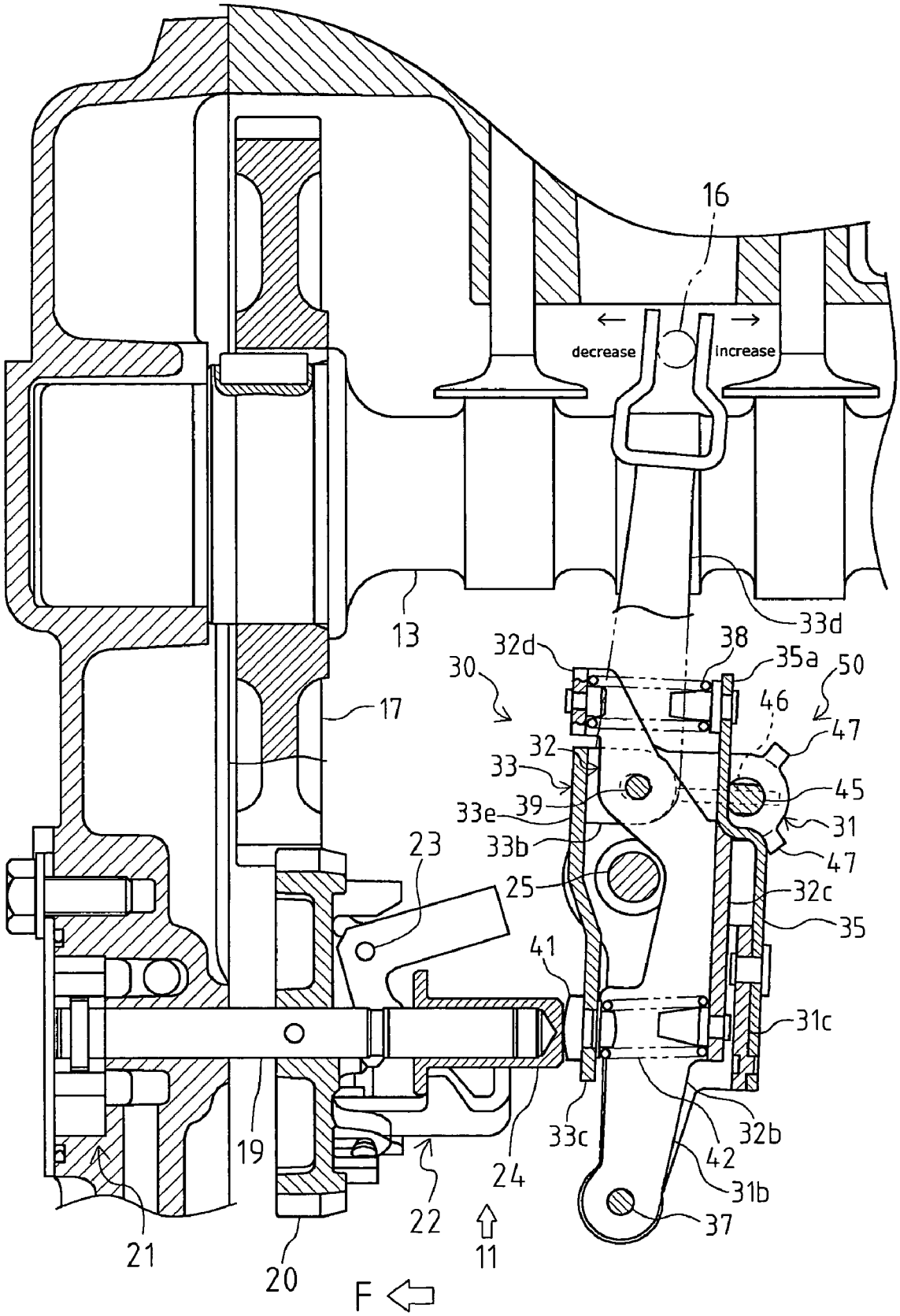
FIG. 3 It is a sectional side view of a governor device.

Explanation will be given according to an air-cooled diesel engine as an embodiment while referring to the direction of an arrow F in FIG. 3 as the front. As shown in FIG. 1, a main body of an engine 1 comprises an upper cylinder block 2 and a lower crankcase 3. A cylinder 2*a* is formed vertically at the center of the cylinder block 2, and a piston 4 is housed in the cylinder 2*a*. A crankshaft 5 is pivotally supported by the crankcase 3, and the crankshaft 5 is connected to the piston 4 through a connecting rod 6.

A cylinder head 7 is arranged above the cylinder block 2 and a bonnet cover 8 is arranged above the cylinder head 7 so as to constitute a rocker arm chamber. A muffler 9 is arranged at one of sides (the left side in FIG. 1) of the cylinder head 7 in the upper portion of the engine, and a fuel tank 10 is arranged at the other side (the right side in FIG. 1) thereof.

A balance weight and a governor device 11 are arranged in the crankcase 3 below the cylinder block 2, and a camshaft 13 and a fuel injection pump 12 are arranged above the governor device 11. Plungers of the fuel injection pump 12 are pushed and pulled by a pump driving cam 14 provided at the longitudinal center of the camshaft 13 so as to suck fuel from the fuel tank 10, and the fuel injection pump 12 supplies a fixed amount of fuel through a high pressure pipe to a fuel injection nozzle 15 at fixed intervals. The fuel injection amount of the fuel injection nozzle 15 can be adjusted by rotating a control lever 16 of the fuel injection pump 12 so as to change the effective stroke of the plungers.

The camshaft 13 is pivotally supported by the crankcase 3 parallel to the crankshaft 5. A cam gear 17 fixed to one of ends of the camshaft 13 is engaged with a gear 18 fixed to the crankshaft 5 and is engaged with a governor gear 20 fixed to a governor shaft 19 as shown in FIG. 3. Accordingly, driving force is transmitted from the crankshaft 5 through the gear 18 and the cam gear 17 to the camshaft 13, and then transmitted from the camshaft 13 through the cam gear 17 and the governor gear 20 to the governor shaft 19, whereby the governor shaft 19 is rotatively driven.

The governor shaft 19 is pivotally supported by the crankcase 3 below the camshaft 13 and parallel to the camshaft 13. The governor gear 20 is fixed to the longitudinal center of the governor shaft 19. A lubricating oil pump 21 is provided at one of the ends of the governor shaft 19 at the side of the crankcase 3 (the front side), and the governor device 11 is provided at the other end thereof (the rear side).

The governor device 11 mainly comprises a governor weight 22 and a governor lever 30. The governor weight 22 is substantially L-like shaped and the middle portion thereof is pivotally supported by the side surface of the governor gear 20 through a rotary shaft 23. Accordingly, one of ends (at the outside) of the governor weight 22 is opened outward against the axis of the governor following the increase of rotary speed of the governor gear 20, and the other end (at the center side) thereof touches (or is connected to) one of ends of a governor sleeve 24. The governor sleeve 24 is cylindrical and one of ends thereof is closed. The opened end of the cylinder has an edge part, and the front surface of the edge part touches the other end of the governor weight 22 mentioned above. The governor sleeve 24 is engaged with the outside of the governor shaft 19 from the end of the governor shaft 19 and is arranged slidably on the governor shaft 19 between the governor weight 22 and the governor lever 30. The closed end of the governor sleeve 24 touches a shifter 41 provided on the governor lever 30.

As shown in FIGS. 2 to 6, the governor lever 30 of the governor device 11 comprises a first lever 31 interlockingly connected to a later-discussed rotary speed setting lever 29, a second lever 32 pivotally supported by the first lever 31, and a third lever 33 pivotally supported by the second lever 32 so as to be regulated in its rotation amount by the second lever 32 and interlocked with the governor weight 22.

The first lever 31 comprises a pair of right and left support parts 31*a* and 31*b* and a connection part 31*c* connecting the support parts 31*a* and 31*b* with each other. The first lever 31 is U-like shaped in plan. An elastic plate 35 comprising a plate spring or the like is fixed to the outer side (rear surface) of the connection part 31*c* and is projected upward. The elastic plate 35 is constructed as a bracket for a later-discussed fuel injection compensation spring 38 at the side of the first lever 31.

A boss part 31*d* is fixed to the inner side of the vertical middle portion of either or each of the support parts 31*a* and 31*b*. The boss part 31*d* is fixed to one of ends of a governor lever shaft 25. The other end (right end) of the governor lever shaft 25 is projected outside the crankcase 3 and is fixed to a regulator lever 26. Accordingly, the first lever 31 is connected to the regulator lever 26 so as to be rotated integrally with the regulator lever 26.

The regulator lever 26 comprises a first arm 26*a*, a second arm 26*b* and a third arm 26*c*. The three arms 26*a*, 26*b* and 26*c* are projected radially from the center of the regulator lever 26 fixed to the governor lever shaft 25.

With regard to the arms 26*a*, 26*b* and 26*c*, the first arm 26*a* and the second arm 26*b* are connected to the rotary speed setting lever 29, arranged at the side surface of the main body of the engine 1, respectively through springs 27*a* and 27*b*. The rotary speed setting lever 29 is rotated along a lever guide 28 and can remain at any rotation position. Accordingly, when the rotary speed setting lever 29 is rotated, the regulator lever 26 is rotated through the springs 27*a* and 27*b*. By the rotation of the regulator lever 26, the first lever 31 is rotated through the governor lever shaft 25, whereby the control lever 16 is rotated which adjusts the fuel injection amount as discussed later. Consequently, by changing the rotation position of the rotary speed setting lever 29, the fuel injection amount is changed so as to change the rotary speed of the engine 1 or stop the engine 1.

The third arm 26*c* is projected downward so as to be able to touch a limiter 36 attached to the side surface of the main body of the engine 1 detachably and adjustably its position. Accordingly, when the rotary speed setting lever 29 is rotated to the driving side, the regulator lever 26 is rotated clockwise in FIG. 2 toward the side increasing the fuel injection amount by the biasing force of the springs 27*a* and 27*b*. Then, the third arm 26*c* touches the limiter 36 so as to regulate the rotation of the first lever 31 toward the side increasing the fuel amount, whereby the fuel injection amount to the fuel injection pump 12 is limited so as to regulate the maximum output.

The second lever 32 of the governor lever 30 comprises a pair of right and left support parts 32*a* and 32*b* and a connection part 32*c* connecting the support parts 32*a* and 32*b* with each other. The second lever 32 is U-like shaped in plan. The opening sides of the second lever 32 and the first lever 31 are arranged in the same direction. The second lever 32 (the support parts 32*a* and 32*b* and the connection part 32*c*) is arranged inside the first lever 31 (the support parts 31*a* and 31*b* and the connection part 31*c*) so that the support parts 31*a* and 31*b* are in parallel to the support parts 32*a* and 32*b* and the connection part 32*c* is in parallel to the connection part 31*c*. The support parts 31*a*, 31*b*, 32*a* and 32*b* are extended downward and overlap when viewed in side. A support shaft 37 is inserted into pivot holes opened at the lower ends of the support parts 31*a*, 31*b*, 32*a* and 32*b* respectively. Through the support shaft 37, the second lever 32 is pivotally supported by the first lever 31.

The support part 32*b* of the second lever 32 is extended higher than the other support part 32*a* (see FIG. 5) and the end of the support part 32*b* is higher than a later-discussed connection part 33*e* of the third lever 33. A tongue-like support part 32*d* is formed at the tip of the support part 32*b* and is bent so as to be substantially in parallel to the connection part 32*c*. The support part 32*d* is extended toward the support part 32*a* and faces a tip 35*a* of the elastic plate 35 projectively provided on the connection part 31*c* of the first lever 31. The fuel injection compensation spring 38 is interposed as an elastic member between the support part 32*d* and the tip 35*a* of the elastic plate 35, and the fuel injection compensation spring 38 bias the second lever 32 toward the governor weight 22 against the first lever 31.

A support shaft 39 is disposed on the upper portion of the second lever 32 so as to connect the second lever 32 rotatably to the later-discussed third lever 33. Both ends of the support shaft 39 are inserted into shaft holes 43 provided on the first lever 31. The inner diameter of each of the shaft holes 43 is larger than the outer diameter of the support shaft 39 in longitudinal direction.

The second lever 32 is slidingly rotatable on the support shaft 37 as a fulcrum. Namely, when the second lever 32 is rotated on the support shaft 37 toward the side decreasing the fuel amount (counterclockwise in FIG. 3) to capacity, the front surface of the support shaft 39 connecting the second lever 32 to the third lever 33 touches one of the shaft holes 43 of the first lever 31. When the second lever 32 is rotated to the reverse direction, the support shaft 39 touches the other shaft hole 43. Accordingly, the rotation of the second lever 32 is regulated against the first lever 31.

The third lever 33 comprises a pair of right and left support parts 33*a* and 33*b*, a connection part 33*e* connecting the support parts 33*a* and 33*b* with each other, a touching part 33*c* extended downward from the connection part 33*e*, and an engaging part 33*d* extended upward from the support part 33*a*. The connection part 33*e* and the support parts 33*a* and 33*b* of the third lever 33 are U-like shaped in plan. The opening sides thereof face that of the second lever 32. The support parts 33*a* and 33*b* are arranged inside the support parts 32*a* and 32*b* of the second lever 32 and outside the support parts 31*a* and 31*b* of the first lever 31. Shaft holes are opened on the support parts 31*a* and 31*b* of the first lever 31, the support parts 32*a* and 32*b* of the second lever 32, and the support parts 33*a* and 33*b* of the third lever 33 so that the positions of the shaft holes are in agreement with each other, whereby the support shaft 39 is inserted into the shaft holes. Accordingly, the second lever 32 and the third lever 33 are pivotally connected to each other through the support shaft 39.

The shifter 41 is provided so as to penetrate the lateral center of the touching part 33*c* extended downward from the connection part 33*e* of the third lever 33. The front surface of the shifter 41 touches the tip of the governor sleeve 24. Accordingly, the third lever 33 is rocked interlockingly with the governor weight 22 through the governor sleeve 24.

A starting spring 42 is interposed between the rear side of the shifter 41 provided on the touching part 33*c* (the inside of the touching part 33*c*) and the lower front surface of the connection part 32*c* of the second lever, and the starting spring 42 biases the touching part 33*c* toward the governor weight 22. Accordingly, the third lever 33 is rotated toward the side increasing the fuel amount at the time of starting the engine, whereby the control lever 16 of the fuel injection pump 12 is positioned at the starting increase position. Therefore, the fuel injection amount is increased at the time of starting so as to make the starting of the engine easy.

Figure 4:
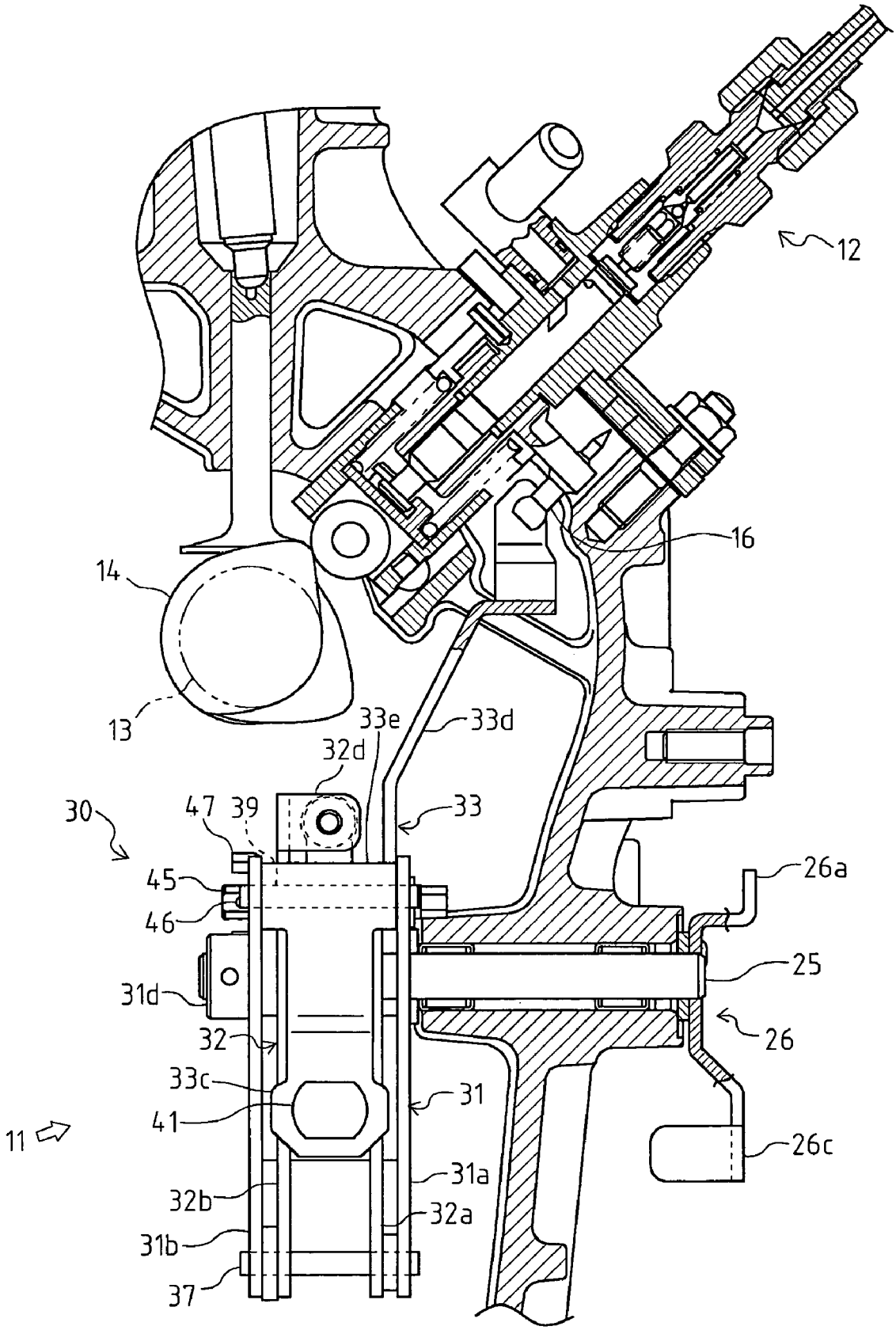
FIG. 4 It is a sectional front view of the same.

In addition, as shown in FIG. 4, the lateral width of the touching part 33*c* is longer than the distance between the support parts 32*a* and 32*b*. Then, when the rotation speed of the engine 1 is increased and the governor sleeve 24 pushes the touching part 33*c* so as to make the starting spring 42 contract, the touching part 33*c* touches the support parts 32*a* and 32*b*, whereby the third lever 33 is rotated integrally with the second lever 32 and the first lever 31 centering on the governor lever shaft 25. At this time, the third lever 33 is rotated centering on the support shaft 39. However, if the third lever 33 is rotated toward the side decreasing the fuel injection amount to capacity, the touching part 33*c* touches the front surfaces of the support parts 32*a* and 32*b*, whereby the rotation is regulated. If the third lever 33 is rotated to the reverse direction, the upper end of the connection part 33*e* touches the upper front surfaces of the support parts 32*a* and 32*b*, whereby the rotation is regulated.

On the other hand, the tip of the engaging part 33*d* extended upward from the third lever 33 is branched and substantially U-like shaped, and is engaged with one of ends of the control lever 16 for adjusting the fuel injection amount of the fuel injection pump 12. Accordingly, when the third lever 33 is rotated by the actuation of the governor device 11 or the rotation of the rotary speed setting lever 29, the control lever 16 is also rotated, whereby the fuel injection amount of the fuel injection pump 12 is adjusted.

As the above mentioned, the third lever 33 is arranged inside the first lever 31 and is rotatably supported by the support parts 31*a* and 31*b* of the first lever 31 through the support shaft 39 together with the second lever 32. The support shaft 39 is pivotally supported in the shaft holes 43 opened at the upper ends of the support parts 31*a* and 31*b* of the first lever 31. Namely, each of the shaft holes 43 is a slot having longitudinal clearance or a circular hole larger than the perimeter of the shaft, and both lateral ends of the support shaft 39 are slidably inserted into the shaft holes 43. However, the diameters of the shaft holes of the second lever 32 and the third lever 33 are substantially the same as the diameter of the support shaft 39 without any clearance. Accordingly, the second lever 32 and the third lever 33 are supported with the support shaft 37, which supports the second lever 32 and the first lever 31 pivotally, as the rotation center so as to be movable against the first lever 31 for the clearance of the shaft holes 43 oppositely to the fuel injection compensation spring 38.

Following the increase of rotary speed of the engine 1 as the above, the governor weight 22 is rotated by the centrifugal force centering on the rotary shaft 23 and is opened, whereby the governor sleeve 24 is slid rearward. By the pushing of the governor sleeve 24, the third lever 33 is rotated together with the first lever 31 and the second lever 32 centering on the governor lever shaft 25 so that the control lever 16 is rotated toward the direction decreasing the fuel injection amount of the fuel injection pump 12, whereby the rotary speed is controlled to a set rotary speed. On the contrary, when the rotary speed is decreased, the governor weight 22 is closed, and the third lever 33 is rotated together with the first lever 31 and the second lever 32 along the opposite direction by the biasing force of the springs 27*a* and 27*b* biasing the regulator lever 26. Then, the control lever 16 is rotated toward the direction increasing the fuel injection amount, whereby the rotary speed is controlled to the set rotary speed.

With regard to this construction, under the rotation within the speed range near the rated rotary speed set by the rotary speed setting lever 29, the starting spring 42 and the fuel injection compensation spring 38 are contracted by the pushing force of the governor sleeve 24 generated by the centrifugal force acting on the governor weight 22. Accordingly, the third lever 33 touches the second lever 32, and the support shaft 39 touches the inner peripheral surface opposite to the governor weight of the shaft holes 43 of the first lever 31 simultaneously, whereby the three levers 31, 32 and 33 are integral with each other rigidly. If the load becomes large and the rotation speed is decreased in this state, the centrifugal force acting on the governor weight 22 becomes small so that the pushing force of the governor sleeve 24 becomes small, whereby the levers 31, 32 and 33 are rotated while being integral with each other rigidly by the biasing force of the springs 27*a* and 27*b* toward the side increasing the fuel injection amount until the third arm 26*c* of the regulator lever 26 touches the limiter 36. This point is referred to as an output limiting point of the engine. In this state, the first lever 31 integral with the regulator lever 26 cannot be rotated toward the side increasing the injection amount further. In the state that the rotary speed is reduced by the large load, this state is maintained.

If the load becomes further large and the rotation speed is decreased, the centrifugal force acting on the governor weight 22 becomes further small so that the pushing force of the governor sleeve 24 becomes smaller than the biasing force of the fuel injection compensation spring 38. Then, the second lever 32 and the third lever 33 touching with each other integrally is rotated on the support shaft 37 as a fulcrum by the biasing force of the fuel injection compensation spring 38 toward the side decreasing the injection amount while the first lever 31 is remained in the above-mentioned state (the rotary speed in this state is referred to as a compensation starting rotary speed), whereby the fuel injection amount is decreased until the support shaft 39 touches the inner peripheral surface opposite to the governor weight of the shaft holes 43 of the first lever 31. Therefore, even if the torque of the engine becomes excessive at the time of decreasing the rotary speed by the load under driving in the set rotary speed, the fuel injection amount is suppressed by the dynamic characteristic of the fuel injection device and the characteristic of the fuel consumption of the engine, thereby suppressing excessive increase of the torque. Accordingly, the discharge of floating particles is suppressed to be less than the limit of exhaust gas.

Furthermore, if the rotary speed is decreased and the centrifugal force acting on the governor weight 22 becomes small so that the pushing force of the governor sleeve 24 becomes smaller than the biasing force of the starting spring 42, the touching between the second lever 32 and the third lever 33 is released on the support shaft 39 as a fulcrum by the biasing force of the starting spring 42, and only the third lever 33 is rotated on the support shaft 39 as a fulcrum toward the side increasing the injection amount, thereby increasing the starting injection amount. In addition, the biasing force of the starting spring 42 is set to be small so as to act only at the time starting at which the rotary speed is very small. Accordingly, the second lever 32 and the third lever 33 are integral and are not separated within the range of normal working rotary speed.

With regard to the present invention, a mechanism for setting the compensation starting rotary speed is provided in the governor lever 30. Namely, a compensation starting rotary speed setting device 50 is a set load changing means changing the set load of the biasing force of the fuel injection compensation spring 38 provided between the first lever 31 and the second lever 32. The compensation starting rotary speed setting device 50 is arranged near the fuel injection compensation spring 38, that is, behind the tip 35*a* at the fixing side receiving the fuel injection compensation spring 38.

In more detail, the fuel injection compensation spring 38 is interposed between the first lever 31 and the second lever 32, and the compensation starting rotary speed setting device 50 is attached to the first lever 31 as the datum (fixing) side. The elastic plate 35 is fixed to the rear surface of the connection part 31*c* of the first lever 31 and is extended upward. The elastic plate 35 comprises a plate spring or the like and is crank-like shaped. The fuel injection compensation spring 38 is interposed between the tip 35*a* of the elastic plate 35 and the support part 32*d* of the second lever 32. An adjusting shaft 45 is arranged to touch the upper rear surface of the elastic plate 35. Both sides of the adjusting shaft 45 are pivotally supported by bearing parts 31*e* and 31*f* formed on the support parts 31*a* and 31*b* of the first lever 31. The bearing parts 31*e* and 31*f* are semicircular plate-like and bulge rearward from the upper rear portions of the support parts 31*a* and 31*b* across the elastic plate 35. Insertion holes 44 are opened on the bearing parts 31*e* and 31*f*, and the adjusting shaft 45 is inserted into and pivotally supported by the insertion holes 44. Namely, the adjusting shaft 45 is arranged laterally horizontally so as to be in parallel to the support shaft 39 and rectangular to the extending direction of the fuel injection compensation spring 38, and is rotatably supported by the first lever 31.

Figure 7:
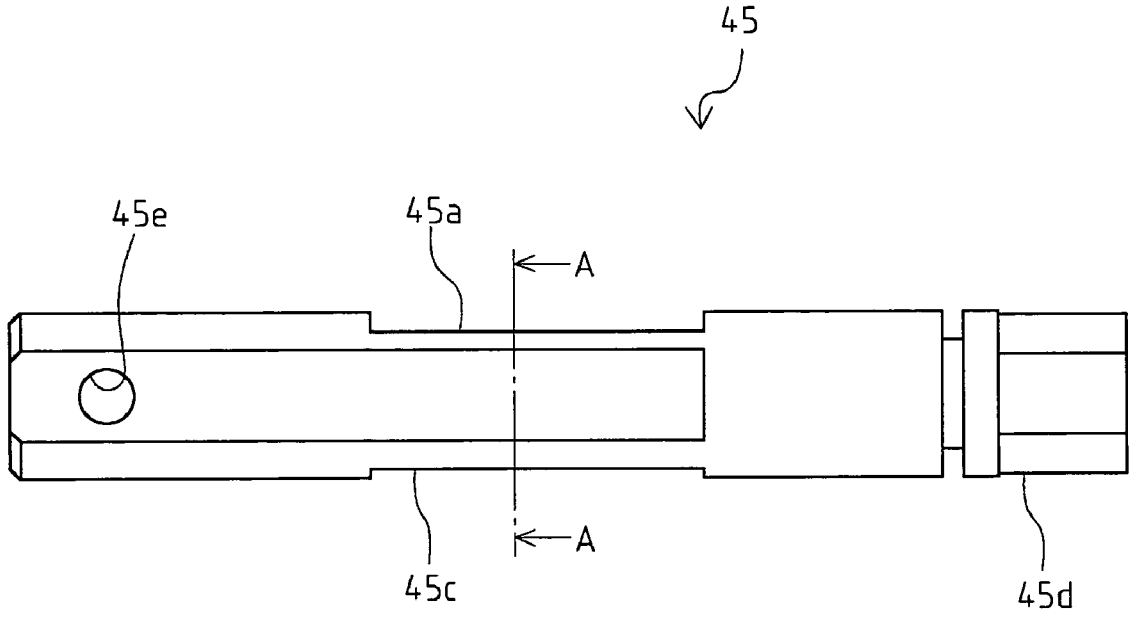
FIG. 7 It is a side view of an adjusting shaft.
Figure 8:
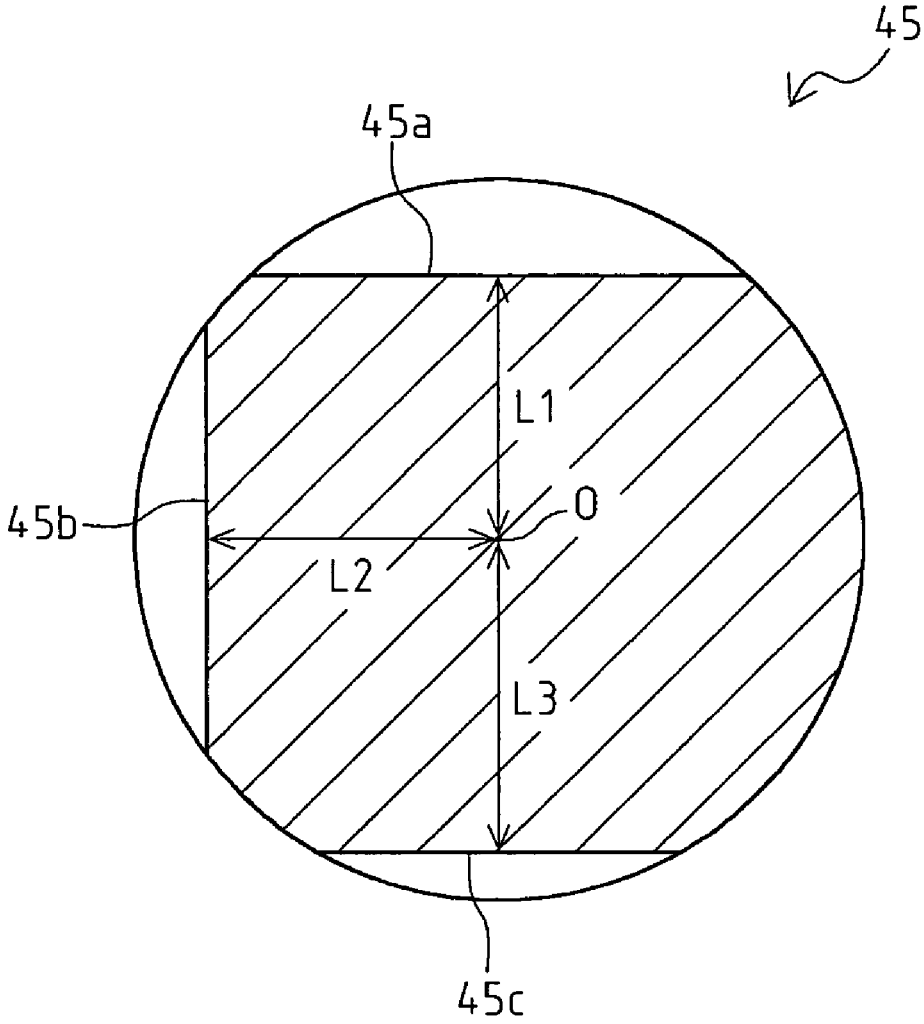
FIG. 8 It is an arrow sectional view of the line A-A in FIG. 7.

The adjusting shaft 45 is arranged oppositely to the fuel injection compensation spring 38 about the elastic plate 35. As shown in FIGS. 7 and 8, flat cut surfaces are formed on the outer perimeter of the part, supported both of its sides by the support parts 31*a* and 31*b*, so as to form touching surfaces 45*a*, 45*b* and 45*c* touching the elastic plate 35. The touching surfaces 45*a*, 45*b* and 45*c* are formed for every 90 degrees in cross-section so that the distances L1, L2 and L3 from the axis O to the touching surfaces 45*a*, 45*b* and 45*c* are stepwise longer than the former (L1<L2<L3). In this embodiment, three surfaces comprising the first surface 45*a*, the second surface 45*b* and the third surface 45*c* are formed on the outer perimeter so as to make three steps. However, the construction is not limited thereto and the sectional shape may be pentagonal or hexagonal and plural surfaces may be formed so as to make the distance from the axis O four steps or more.

According to this construction, by rotating the adjusting shaft 45 so as to change the position of the elastic plate 35, the working load to the second lever 32 by the fuel injection compensation spring 38 (so-called set load) is changed, thereby changing the timing of the working starting of the fuel injection compensation spring 38, that is, the working starting rotary speed. Accordingly, if the rotary speed is decreased to the rotary speed adjusted by the adjusting shaft 45 under the driving in the set rotary speed, the third lever 33 is suppressed to be rotated to the increasing side by the spring biasing force of the fuel injection compensation spring 38, whereby the fuel injection amount is reduced for a fixed amount and the discharge of floating particles is suppressed more than the conventional construction.

In the state that the touching surfaces 45*a*, 45*b* and 45*c* of the adjusting shaft 45 touch the elastic plate 35, the adjusting shaft 45 is pushed to the elastic plate 35 by the biasing force of the elastic plate 35. Accordingly, when the adjusting shaft 45 is rotated for the adjustment, the operating force is changed for every 90 degrees as if the detent effect is affected, whereby the adjusting position is known according to the operation feeling without any scale or the like. Since the operating positions are plural, the set compensation fuel injection amount can be changed easily, and the resettability is also improved. In addition, the radius of sectional shape of the outer peripheral surface may be constructed to be increased gradually. In this case, a detent mechanism must be provided separately.

The adjusting shaft 45 and the fuel injection compensation spring 38 are provided oppositely to the pivotal support part of the first lever 31 and the second lever 32 (the support shaft 37) in the vertical direction. Namely, the adjusting shaft 45 and the fuel injection compensation spring 38 are arranged away from the rotary fulcrum of the first lever 31 and the second lever 32. Accordingly, the working load of the spring is not necessary to be large, whereby the fine adjustment can be performed easily in case of the changing of the set compensation fuel injection amount. The spring constant of the fuel injection compensation spring 38 is permitted to be small, whereby the dispersion of the set load is reduced.

An engaging part 45*d* engaged with an adjusting operation means is formed on one of side ends of the adjusting shaft 45. In this embodiment, the engaging part 45*d* is hexagonal shaped in cross-section so as to be engaged with a box wrench or the like so as to rotate the adjusting shaft 45. However, the shape is not limited thereto, and a groove may be shaped in the diametrical direction of the engaging part 45*d* so as to be rotated with a minus driver. Alternatively, a cross groove may be shaped on the engaging part 45*d* so as to be rotated with a plus driver. Alternatively, a hexagonal groove may be shaped on the engaging part 45*d* so as to be rotated with a hexagonal wrench. According to such a construction, the engaging part 45*d* is not a hindrance to the working of the governor device 11 and can be formed easily.

Figure 2:
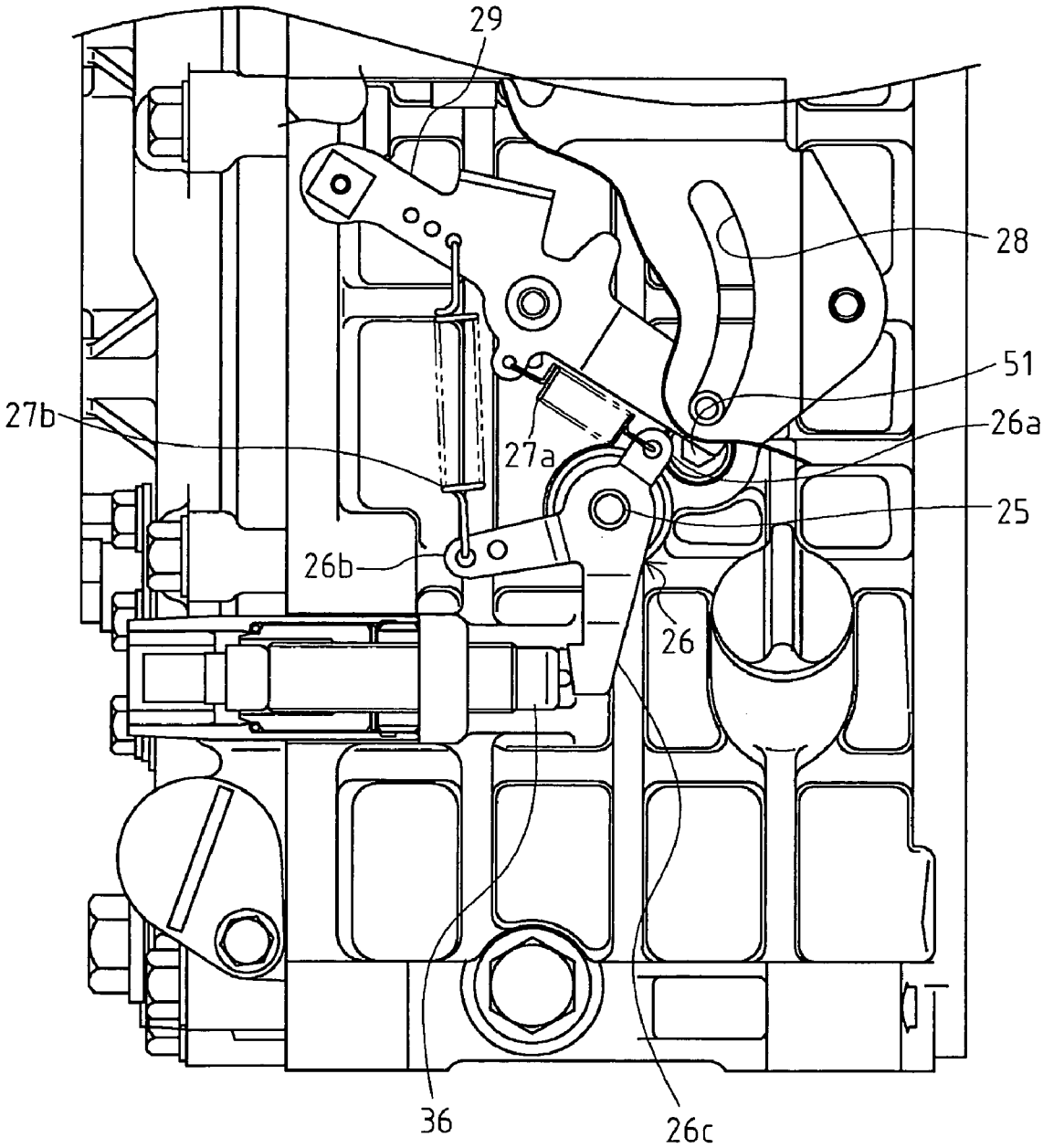
FIG. 2 It is a side view of the same.

An operation hole is opened on the side surface of the crankcase 3 in the extending direction of the adjusting shaft 45. The operation hole is enough large to be inserted therein with the adjusting operation means for rotating the adjusting shaft 45. As shown in FIG. 2, without in the case of the adjusting work, the operation hole is closed by a lid member 51 such as a bolt. According to this construction, though the governor device 11 is arranged inside the casing of the engine 1, the set compensation fuel injection value can be changed easily from the outside of the engine 1 by removing the lid member 51 and inserting the adjusting operation means through the operation hole so as to rotate the adjusting shaft 45.

Figure 5:
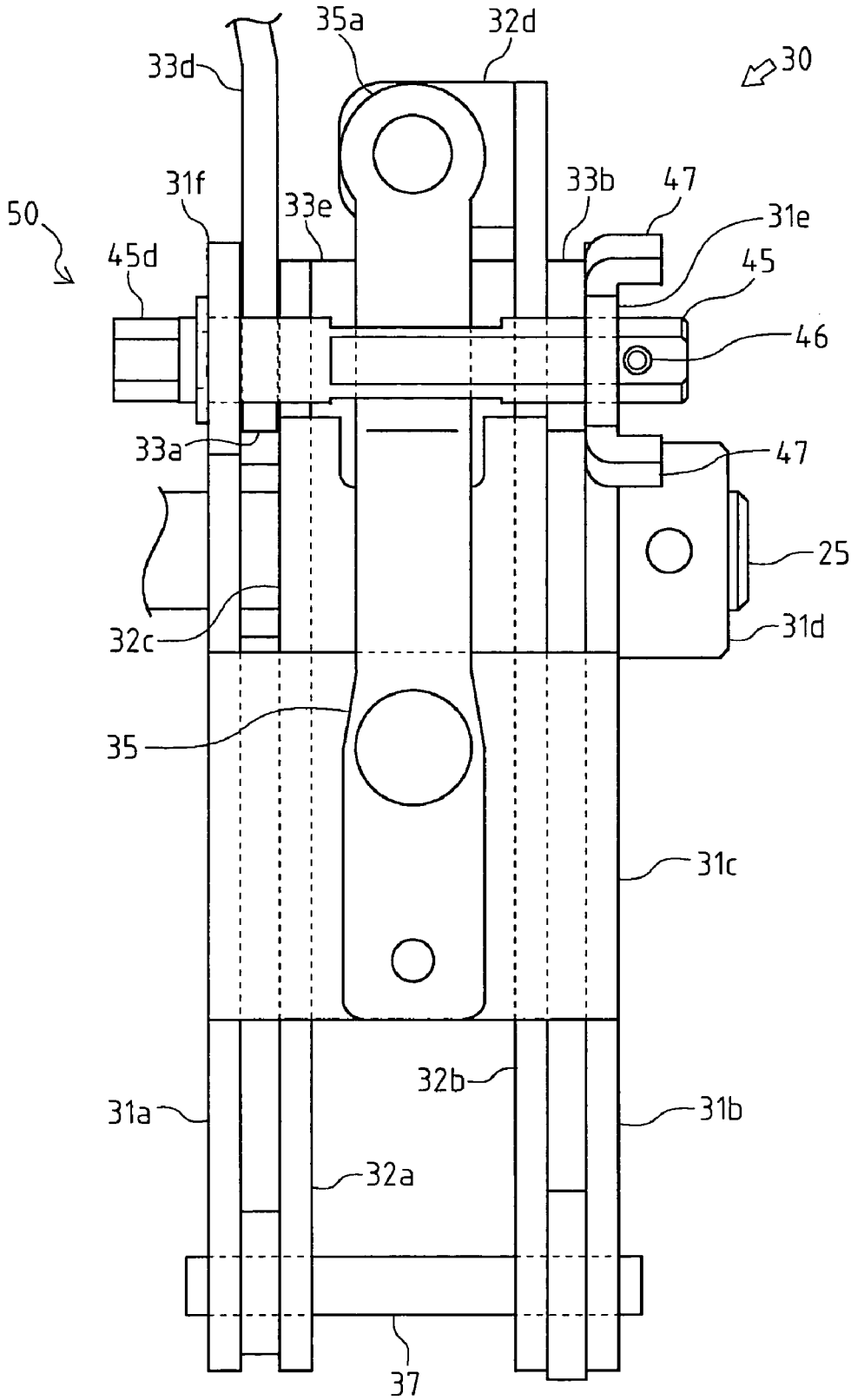
FIG. 5 It is a rear view of a governor lever.
Figure 6:
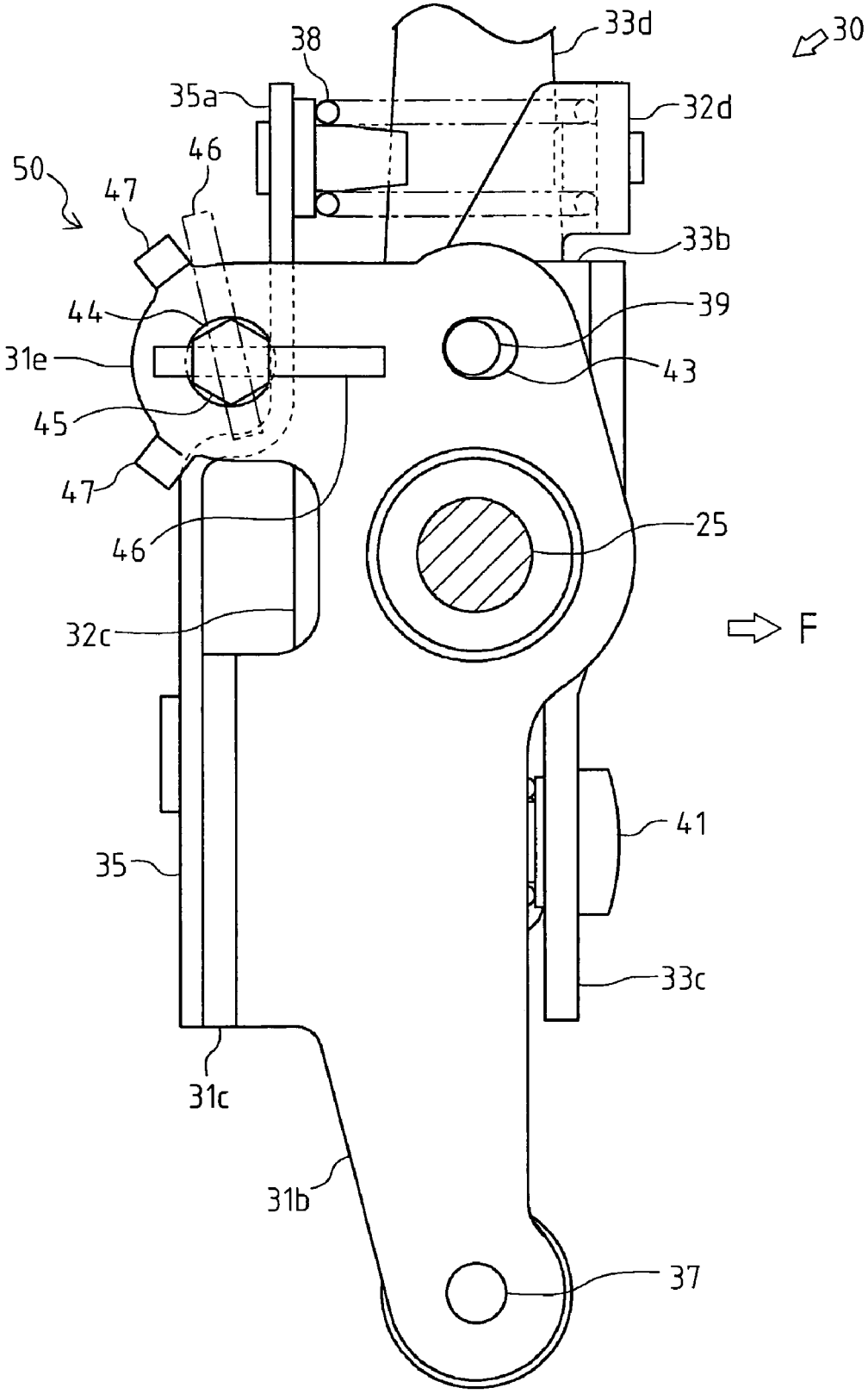
FIG. 6 It is a side view of the same.

As shown in FIGS. 5 and 6, a rotation limiting mechanism is disposed on one of ends of the adjusting shaft 45 (the disposing side may be the same as the engaging part 45*d* or opposite thereto). The rotation limiting mechanism comprises a rotation limiting member 46 and projections 47 which the rotation limiting member 46 touches. In this embodiment, the rotation limiting member 46 is constructed by a pin, a spring pin or the like. An insertion hole 45*e* is opened one of ends of the adjusting shaft 45 along the diametrical direction, and the rotation limiting member 46 is inserted into the insertion hole 45*e* and fixed, whereby the rotation limiting member 46 is rotated integrally with the adjusting shaft 45. However, the rotation limiting member 46 may be fixed to the adjusting shaft 45 by welding or the like so as to be projected along the radial direction. Alternatively, the rotation limiting member 46 may be constructed by engaging from the outside and fixing a boss having a projection. Alternatively, the rotation limiting member 46 may be constructed by making the tip of the adjusting shaft 45 thin and bending the tip rectangularly. The rotation limiting member 46 is only necessary to be projected from the outer perimeter of the end of the adjusting shaft 45 in the radial direction and to be rotated integrally with the adjusting shaft 45, and the construction is not limited.

The rotation limiting member 46 is arranged at the side of the bearing part 31*e* of the first lever 31 rotatably supporting the adjusting shaft 45. The projections 47 which can touch the rotation limiting member 46 are provided so as to be projected outward from the outer perimeter of the bearing part 31*e*. In this embodiment, the projections 47 are projectingly provided centering on the insertion holes 44 opened on the bearing part 31*e* at an interval of a fixed angle. The projections 47 are bent toward the side at which the rotation limiting member 46 is arranged so that the rotation limiting member 46 touches the projections 47 when the adjusting shaft 45 is rotated. In addition, the projecting positions of the projections 47 are set corresponding to the positions of the touching surfaces 45*a*, 45*b* and 45*c* formed on the adjusting shaft 45 and the position of the elastic plate 35. Namely, the rotation limiting member 46 touches the projections 47 at the position at which the touching surface 45*a* touches the elastic plate 35 and the position at which the touching surface 45*c* touches the elastic plate 35.

According to this construction, when the adjusting shaft 45 is rotated, the rotation limiting member 46 touches the projections 47 so as to be stopped, whereby the adjusting shaft 45 cannot be rotated for 360 degrees or more. Accordingly, in the case of adjusting from the outside of the engine 1 as the above mentioned for example, the adjustment can be performed easily with three steps, that is, the positions touching the projections 47 and the position therebetween. The adjusted position can be recognized sensuously easily, whereby any scale is not necessary to be provided. The rotary range of the adjusting shaft 45 can be adjusted with easy construction in the case of changing the set load by rotating the adjusting shaft 45.

Though two projections 47 are formed in this embodiment, the projection may be one. Though the projections 47 are bent in this embodiment, it may be constructed so that a hollow is formed by striking the side surface of the bearing part 31*e* by a punch so as to form a projection on the side of the rotation limiting member 46 as the projection 47. Alternatively, the projection 47 may be constructed by standingly providing a pin or the like on the side surface of the bearing part 31*e*. The construction of the projection is not limited.

As the above, the governor device 11 comprises the first lever 31 connecting the governor lever 30 to the rotary speed setting lever 29 interlockingly, the second lever 32 pivotally supported by the first lever 31, and the third lever 33 pivotally supported by the second lever 32, regulated its rotation amount by the second lever 32 and interlocked with the governor weight 22. The fuel injection compensation spring 38 is provided between the first lever 31 and the second lever 32 so as to biases them for decreasing the rotary speed for a fixed amount at the time of low speed rotation. The compensation starting rotary speed setting device 50, which is a set load changing means for the fuel injection compensation spring 38, is provided on the first lever 31 near the fuel injection compensation spring 38. Accordingly, by adjusting the adjusting shaft of the fuel injection compensation spring 38, the set compensation fuel injection value can be changed so as to prevent the dispersion of each governor device 11.

Since the set compensation fuel injection value can be changed by adjusting the set load of the fuel injection compensation spring 38, the fine adjustment of the rotary speed at which the fuel injection compensation spring 38 starts to act, whereby the torque can be controlled in the low rotation range.

INDUSTRIAL APPLICABILITY

With regard to the governor device according to the present invention, the limit starting position of the fuel injection amount can be set easily from the outside, thereby being useful industrially.

The invention claimed is:

1. A governor device comprising:

a first lever interlockingly connected to a rotary speed setting lever;

a second lever pivotally supported by the first lever;

a third lever pivotally supported by the second lever, its rotation amount regulated by the second lever and interlocked with a governor weight;

an elastic member provided between the first lever and the second lever so as to bias the levers for decreasing a rotary speed of an engine for a fixed amount at a time of low speed rotation; and a set load changing means for the elastic member attached to the first lever near the elastic member.

2. A governor device as set forth in claim 1, wherein a bracket for the elastic member at the side of the first lever is constructed by an elastic plate, the elastic plate touches an outer peripheral surface of an adjusting shaft, and a distance between the outer peripheral surface of the adjusting shaft and an axis is changed by stages.

3. A governor device as set forth in claim 2, wherein a rotation limiting member is projected from one of ends of the adjusting shaft, and a projection which can touch the rotation limiting member is provided on a plate supporting the adjusting shaft.

4. A governor device as set forth in claim 2, wherein an engaging part for an adjusting operation means is formed on one of sides of the adjusting shaft.

5. A governor device as set forth in claim 2, wherein the elastic member and the adjusting shaft are provided oppositely to a pivotal support part of the first lever and the second lever.

6. A governor device as set forth in claim 1, wherein the governor weight acts directly on the third lever.

7. A governor device as set forth in claim 1, wherein the governor device is enclosed in a crankcase comprising an opening that allows adjustment of the set load changing means.

8. A governor device comprising:

a first lever interlockingly connected to a rotary speed setting lever;

a second lever separate from and pivotally supported by the first lever;

a third lever pivotally supported by the second lever, its rotation amount regulated by the second lever and interlocked with a governor weight;

an elastic member provided between the first lever and the second lever so as to bias the levers for decreasing a rotary speed of an engine for a fixed amount at a time of low speed rotation; and a set load changing means for the elastic member attached to the first lever near the elastic member.

9. A governor device as set forth in claim 8, wherein a bracket for the elastic member at the side of the first lever is constructed by an elastic plate, the elastic plate touches an outer peripheral surface of an adjusting shaft, and a distance between the outer peripheral surface of the adjusting shaft and an axis is changed by stages.

10. A governor device as set forth in claim 9, wherein a rotation limiting member is projected from one of ends of the adjusting shaft, and a projection which can touch the rotation limiting member is provided on a plate supporting the adjusting shaft.

11. A governor device as set forth in claim 9, wherein an engaging part for an adjusting operation means is formed on one of sides of the adjusting shaft.

12. A governor device as set forth in claim 9, wherein the elastic member and the adjusting shaft are provided oppositely to a pivotal support part of the first lever and the second lever.

13. A governor device as set forth in claim 8, wherein the governor weight acts directly on the third lever.

14. A governor device as set forth in claim 8, wherein the governor device is enclosed in a crankcase comprising an opening that allows adjustment of the set load changing means.

15. A governor device comprising:

a first lever interlockingly connected to a rotary speed setting lever;

a second lever pivotally supported by the first lever;

a third lever pivotally supported by the second lever, its rotation amount regulated by the second lever and interlocked with a governor weight;

an elastic member provided between the first lever and the second lever so as to bias the levers for decreasing a rotary speed of an engine for a fixed amount at a time of low speed rotation;

a bracket for the elastic member at a side of the first lever constructed by an elastic plate; and a set load changing means for the elastic member attached to the first lever near the elastic member, comprising a rotatable adjusting shaft, wherein the elastic plate touches an outer peripheral surface of the adjusting shaft and a distance between the outer peripheral surface of the adjusting shaft and an axis is changed by stages.

16. A governor device as set forth in claim 15, wherein a rotation limiting member is projected from one of ends of the adjusting shaft, and a projection which can touch the rotation limiting member is provided on a plate supporting the adjusting shaft.

17. A governor device as set forth in claim 15, wherein an engaging part for an adjusting operation means is formed on one of sides of the adjusting shaft.

18. A governor device as set forth in claim 15, wherein the elastic member and the adjusting shaft are provided oppositely to a pivotal support part of the first lever and the second lever.

19. A governor device as set forth in claim 15, wherein the governor weight acts directly on the third lever.

20. A governor device as set forth in claim 15, wherein the governor device is enclosed in a crankcase comprising an opening that allows adjustment of the set load changing means.

* * * * *